United States Patent [19]

Kakihana et al.

[11] Patent Number: 4,614,094

[45] Date of Patent: Sep. 30, 1986

[54] COVERING FABRIC FOR A DAMPING ROLLER OF AN OFFSET PRINTING MACHINE

[75] Inventors: Kazumasa Kakihana, Nara; Hiroshi Nishiwaki, Izumi, both of Japan

[73] Assignee: Techno Roll Co., Ltd., Japan

[21] Appl. No.: 514,240

[22] Filed: Jul. 15, 1983

[30] Foreign Application Priority Data

Jul. 27, 1982 [JP] Japan ..... 57-131051

[51] Int. Cl.[4] ..... D04B 1/04; D04B 9/12; D04B 9/16

[52] U.S. Cl. ..... 66/170; 66/190; 66/194

[58] Field of Search ..... 66/170, 191, 194, 190; 428/85, 93, 229, 257, 909

[56] References Cited

U.S. PATENT DOCUMENTS

| | | | |
|---|---|---|---|
| 2,484,293 | 10/1949 | Hinchliff | 66/170 |
| 3,023,596 | 3/1962 | Hill | 66/194 |
| 3,221,449 | 12/1965 | Lewis et al. | 66/170 X |
| 3,926,701 | 12/1975 | Nishiwaki | 66/194 X |
| 4,043,142 | 8/1977 | Marshall | 66/170 |
| 4,400,418 | 8/1983 | Takeda et al. | 66/194 X |

*Primary Examiner*—Wm. Carter Reynolds
*Attorney, Agent, or Firm*—Darby & Darby

[57] ABSTRACT

A covering for a damping form roller prepared by knitting fabric into a cylindrical form consists of a pile yarn, a ground yarn and an elastic annex yarn. This elastic yarn knitted to straightly extend in a direction of a course, and to be caught and bound by base knit loop.

The shrinking of a covering fabric of the invention which is inserted on the roller is more larger in the direction of circumference than in the direction of axis, and this shrinking in the direction of circumference sticks the inner surface of a covering fabric fast to the outer surface of roller, the shrinking in the direction of axis is very small. Thus the covering fabric sticks so fast to a roller without inequality that it is not necessary to bind both side ends of a covering fabric on the shaft of roller in mounting it on a roller, and can be supply water to the plate cylinder in a smooth and uniform manner, aiding in producing fine and beautiful prints continuously for a long period of time.

6 Claims, 2 Drawing Figures

COVERING FABRIC FOR A DAMPING ROLLER OF AN OFFSET PRINTING MACHINE

BACKGROUND OF THE INVENTION

This invention relates to an improved covering fablic named "molton" to form the outer surface of a damping roller of a printing machine for supplying water to a plate cylinder. More particulaly, this invention relates to a covering fablic for a damping roller of a printing machine prepared by knitting fibers shrinkable by oneself or by water as annex yarns and hydrophilic fibers as ground yarns and as pile yarns.

In offset printing it is necessary to supply water to the plate cylinder of an offset printing machine, and this water supply is an important factor in determining the finishing of prints. Hitherto, the most popular damping roller covering fabrics, used to supply water to the plate cylinder, were prepared by fabricating a cloth made by knitting or weaving cotton into a cylindrical shape, mounting it onto a damping roller or a water ductor roller, and stretching and binding it by pulling the opposite ends of the cylindrically shaped cloth before use.

However, this conventional technique is accompanied with difficulties in that the covering fabric is apt to be loosened by the centrifugal force during rotary use of it, the supply of water to the plate cylinder becomes uneven due to uneven stitching, and cutting takes place which results in reducing the printing precisensess.

The printing operation must, therefore, be interrupted frequently to replace the covering fabric with a fresh one or to rebind the old one, which results in reducing efficiency of the printing operation. Also, the replacing operation of the covering fabric is quite troublesome and requires expensive skilled labor.

So, to solve such a problem, the inventor of this invention had before invented this kind of water-shrinkable covering fabric that is disclosed in U.S. Pat. No. 3,926,701, issued on Dec. 16, 1975, and has been put to practical use. However, it is necessary for a water-shrinkable covering fabric of prior art to bind with wire or yarn in advance both of its ends on the shafts extending out from both sides of roller, because a covering fabric inserted on a roller shrinks in the direction of axis of roller as well as in the direction of circumference of roller when immersed in water. The shrinkage which occurs unevenly because of a friction between a covering fabric and the outer surface of roller makes the diameter of roller covered with a covering fabric unequal at the side of roller and its middle, making the outer surface of roller uneven. In the case of this roller, as a result of shrinkage, the supply of water, that is an important factor is determining the finishing of prints becomes uneven.

SUMMARY OF THE INVENTION

The main object of the present invention is to provide a cylindrical knitted covering fabric that is inserted in a damping roller of an offset printing machine is far more shrinkable in the direction of circumference of a damping roller, and is far less shrinkable in the direction of axis of roller, and sticks fast to the outer surface of a damping roller without producing any shrinking spots.

The covering fabric of present invention which has on the outer surface a pile is knitted by such a circular knitting machine as a circular rib knitter, by knitting in an annex yarn with a ground yarn. That is, the covering fabric of present invention consists of a pile and a ground on which a pile is tufted, and the ground consists of an annex yarn and a ground yarn.

To fulfill the above object, an annex yarn does not form a knit loop but straightly extends in the direction of a knitting course threading through between knit loops of ground yarn which stand each knitting wale in succession in the direction of a knitting course, and a high water-shrinkable annex yarn is used, the water shrinking ratio of which is larger than that of the yarn that may be used as a ground yarn. That is, the knitting structure of a ground of a covering fabric of present invention is composed of knit loops of ground yarn standing in succession in the directions of a knitting course and a knitting wale, and a pile is fixed on the ground of covering fabric by intertwining a pile yarn with a knit loop of ground yarn. On the other hand, the annex yarns which stand on each knitting course are not chained by each other, and are not knitted in to fix a pile on the ground of covering fabric.

And, since an annex yarn is far more shrinkable than a ground yarn and does not form a knit loop but forms a straightly extending portion in the direction of a knitting course, that is, in the direction of circumference of a covering fabric;

compared with the conventional covering fabric which used a water-shrinkable yarn as a ground yarn to form a base knit loop at every wale, the shrinking of a covering fabric of the invention which is inserted on the roller is more larger in the direction of circumference than in the direction of axis, and this shrinking in the direction of circumference sticks the inner surface of a covering fabric fast to the outer surface of roller, and the shrinking in the direction of axis does not occur. Thus the covering fabric sticks so fast to a roller without inequality that it is not necessary to bind both side ends of a covering fabric on the shaft of roller in mounting it on a roller. Besides the covering fabric may be mounted on such roller from both sides of which the journals are not extending out. And, further, when the roller covered with a covering fabric of the invention is used for a damping roller, water is supplied to a plate cylinder in a smooth uniform manner. To obtain best results, such water-shrinkable yarn as non-acetalized polyvinyl alcohol yarn (vinylon) may be used as an elastic yarn. A water-absorbable and/or hydrophilic property yarn, for example, a cotton, a rayon and a cuprammonium rayon (cupra), may be employed as a pile yarn and a ground yarn.

The objects and features of this invention will become more apparent from the following detailed description and accompanying drawing.

DESCRIPTION OF THE PREFERRED EMBODIMENT

The present invention provides a cover for a damping roller prepared knitting fabric into a cylindrical form.

Figure 1:
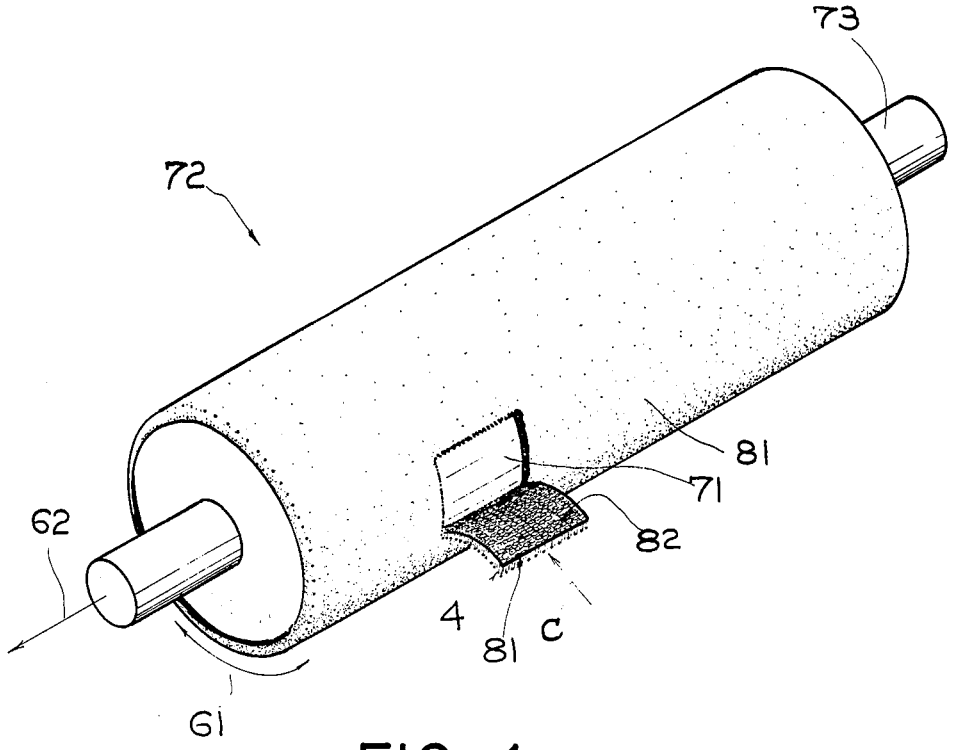
FIG. 1 is a fragmental view of a damping roller covered by a covering fabric made in accordance with the present invention.

FIG. 1 shows a damping roller 72 covered with a cylindrical knitted covering fabric 81 that has been partially cut away to show the inner surface 82 of covering fabric 81.

Figure 2:
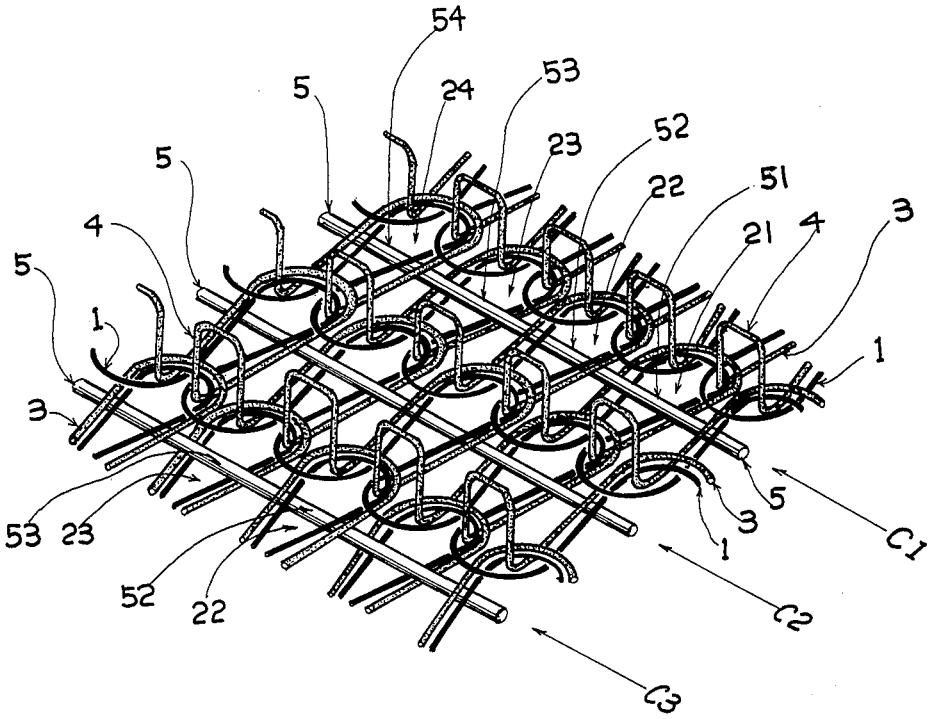
FIG. 2 is a fragmental view to show a knitting structure of a cylindrical knitted covering fabric embodied in accordance with the present invention.

FIG. 2 illustrates the structure of a covering fabric knitted in accordance with the present invention. A ground yarn 1 is knitted in each knitting courses C1, C2, C3 to form base knit loops 21, 22, 23, 24 of a plane stitch which is one kind of a structure of knitted fablic, while a pile yarn 3 stands up and forms a pile 4 at the portion where the adjacent courses of a base knit loop are chained by each other.

An annex yarn 5 is supplied by one feeder of knitting machine, and a ground yarn 1 and a pile yarn 3 are respectively supplied by other feeders.

In the embodiment shown in FIG. 2, an annex yarn 5 is supplied and knitted in each course C1, C2, C3 being threaded through between the base knit loops 21 and 22, 22 and 23, 23 and 24 to extend straightly in the direction of a course, and forms straightly extending portions 51, 52, 53, 54 alternately above or under the base knit loops 21, 22, 23, 24 in the following manner;

to extend over the base knit loop 21 and to penetrate downwardly between the base knit loop 21 and the next adjacent base knit loop 22, to extend under the base knit loop 22 and to penetrate upwardly between the base knit loop 22 and the next adjacent base knit loop 23, and again to extend over the base knit loop 23 and to penetrate downwardly between the base knit loop 23 and the next adjacent base knit loop 24, to extend under the base knit loop 24, and to repeat in such a manner as herein above-mentioned. A non-acetalized polyvinyl alcohol yarn (vinylon) having a high water-shrinkable nature is used as the annex yarn 5. A water-absorbable and/or hydrophilic property yarn, for example, a cotton, a rayon and a cuprammonium rayon (cupra), may be used as the pile yarn 3 and the ground yarn 1. However, it is essential of this invention that the annex yarn 5 is more water-shrinkable than the ground yarn 3.

A loop pile 4 is disguised into a cut pile by shearing after it is knitted up. From the above embodiment it will be appear that the present invention includes such effects as;

since the water-shrinkable yarn 5 does not form a knit loop but forms the straightly extending portions 51, 52, 53, 54 . . . in the direction of the courses C1, C2, C3 . . . , that is, in the direction 61 of circumference of the covering fabric;

compared with the conventional covering fabric which used a water-shrinkable yarn as a ground yarn to form a base knit loop at every wale, the shrinking of a covering fabric of the invention which is inserted on the damping roller is larger in the direction 61 of circumference than in the direction 62 of the roller 72 axis, and this shrinking in the direction 61 of circumference sticks the inner surface of a covering fabric fast to the outer surface 71 of roller 72, shrinking in the direction 62 of the axis does not occur.

Thus the covering fabric 81 sticks so fast to a roller 72 without inequality that it is not necessary to bind both side ends of a covering fabric on the shaft 73 in mounting it on roller 72. Besides the covering fabric may be mounted on a roller from both sides of which the journals are not extended out. And, furthere, when the roller covered with a covering fabric of the invention is used for a damping roller, water is supplied to a plate cylinder in a smooth uniform manner.

EXAMPLE 1

Two-ply of No. 20 count cotton yarn was used as a pile yarn 3, three-ply of No. 20 count cotton yarn was used as a ground yarn 1, and 650 denier of vinylon yarn which is capable of shrinking by 37% when immersed in water was used as an annex yarn 5. These three kinds of yarn were knitted into a cylindrical form of a covering fabric 81 which has just the same structure as shown in FIG. 2 by means of a circular knitting machine 101.6 mm in diameter, employing 134 needles.

EXAMPLE 2

Using 900 denier of rayon filament yarn as a pile yarn 3, and 480 denier of cupra rayon filament yarn as a ground yarn 1, and employing an annex yarn 5, a circular knitting machine and a structure of fablic which are respectively just the same as used for EXAMPLE 1, a cylinder form of a covering fabric 81 was knitted.

EXAMPLE OF PRIOR ART

Using 8 threads of 120 denier of cupra rayon filament yarn as a pile yarn 3, 650 denier of water-shrinkable vinylon filament yarn as a ground yarn 1, and just the same circular knitting machine as used for EXAMPLE 1, a cylindrical form of a covering fabric was knitted as shown in Figure, but there was not an annex yarn 5, that is, an annex yarn 5 was not knitted in.

Three kinds of test piece having a length of 200 mm in the direction of axis of a covering fabric were prepared by cutting off three kinds of covering fabric provided from above-mentioned examples No. 1, No. 2 and of prior art respectively, and they were tested by immersing them in water for 30 minutes and by measuring their circumference and length before and after immersing.

The results of these tests are shown in the under table.

| test item | kind of test piece | example (1) of this invention | example (2) of this invention | example of this prior arts |
|---|---|---|---|---|
| measure of circumference | before immersing | 240 mm | 220 mm | 206 mm |
| | after immersing | 195 mm | 170 mm | 202 mm |
| | ratio of shrinking | 19.0% | 23.0% | 2.0% |
| measure of length in axis-direction | before immersing | 200 mm | 200 mm | 200 mm |
| | after immersing | 195 mm | 197 mm | 160 mm |
| | ratio of shrinking | 2.5% | 1.5% | 20.0% |

From the above test table it will become evident that the present invention is surely effective, because the shrinking of a covering fabric of this invention is very small in the direction of axis, but it is very large in the direction of circumference 61, and the shrinking rate in the direction of circumference 61 is about 10 times as high as that in the direction of axis 62, while the shrinking of a covering fabric of prior arts is very small in the direction of circumference, and the shrinking rate in the direction of circumference is about 10% of that in the direction of axis.

What is claimed is:

1. A cylindrical, knitted damping roller cover having a circumference, comprising:

at least one ground yarn comprised of water absorbable yarn forming a plurality of plain stitch base knit loops extending adjacently in adjacent parallel knitting courses, said courses being formed in a direction of said circumference, said base knit loops from said adjacent parallel courses being chained one with the other;

at least one pile yarn comprised of water absorbable yarn forming piles standing up at the region of chaining of said base knit loops; and at least one annex yarn comprised of water shrinkable yarn having a higher shrinking ratio than said ground yarn threaded between said base knit loops extending substantially straightly in said direction of said courses, said annex yarn passing over a first base knit loop in a course passing downwardly between said first base knit loop and an adjacent base knit loop in the same course to pass thereunder and passing upwardly between said adjacent base knit loop and a next adjacent base knit loop in said course to pass over another base knit loop.

2. The cylindrical knitted damping roller cover according to claim 1 wherein the shrinking ratio of said cover is substantially greater along the circumference of said cylindrical roller than in the direction of the longitudinal axis of said cylindrical roller cover.

3. The cylindrical knitted damping roller cover according to claim 1 wherein said annex yarn is comprised of non-acetylized polyvinyl alcohol yarn.

4. The cylindrical knitted damping roller cover according to claim 2 wherein said annex yarn is comprised of non-acetylized polyvinyl alcohol yarn.

5. The damping roller cover according to claim 1 wherein said pile yarn and said ground yarn are selected from the group comprised of cotton yarn, rayon yarn and cuprammonium yarn.

6. The damping roller cover according to claim 2 wherein said pile yarn and said ground yarn are selected from the group comprised of cotton yarn, rayon yarn and cuprammonium yarn.

* * * * *